United States Patent [19]

Casagrande

[11] 4,035,969

[45] July 19, 1977

[54] TELESCOPIC COLUMNS OF MACHINES FOR MAKING FOUNDATIONS, AND THE TELESCOPIC COLUMNS THEREBY DERIVED

[76] Inventor: Bruno Casagrande, Viale Zancanaro, 33077 Sacile, Italy

[21] Appl. No.: 690,050

[22] Filed: May 25, 1976

[30] Foreign Application Priority Data

June 4, 1975 Italy ..... 83388/75

[51] Int. Cl.[2] ..... E04H 12/34

[52] U.S. Cl. ..... 52/111; 61/53.5; 52/121; 173/147; 173/44; 254/148

[58] Field of Search ..... 61/53.5–59; 173/147, 43, 44; 175/321; 52/111, 118, 632, 121; 254/143, 148; 214/141, 138; 64/24, 26

[56] References Cited

U.S. PATENT DOCUMENTS

| | | | |
|---|---|---|---|
| 2,958,514 | 11/1960 | Lee | 173/147 X |
| 3,517,760 | 6/1970 | Kehrberger | 175/321 |
| 3,520,374 | 7/1970 | Ebert | 173/147 X |
| 3,645,343 | 2/1972 | Mays | 173/147 X |
| 3,753,468 | 8/1973 | Casagrande | 173/147 X |
| 3,835,936 | 9/1974 | Lagerstedt et al. | 173/43 X |
| 3,845,596 | 11/1974 | Veenstra | 52/121 X |
| 3,917,005 | 11/1975 | Cannon et al. | 173/43 X |

*Primary Examiner*—Dennis L. Taylor

*Attorney, Agent, or Firm*—Stevens, Davis, Miller & Mosher

[57] ABSTRACT

Telescopic columns for making foundations including in reciprocal coordination and cooperation a motor group comprising at least two guide pulleys having a proportion to each other of one to two; inner and outer movable columns; axially immovable canoe guide means surrounding said columns; a chain secured to the two ends of the outer movable column and driven by the smaller of said pulleys; a chain secured to the lower part of the inner movable column and to the upper part of the axially immovable guide canoe means and driven by the larger pulley; a cable connecting the upper part of the inner movable column to the lower part of the axially immovable guide canoe means and a transmission sheave solidly fixed to the lower part of the outer movable column through which passes said cable.

5 Claims, 4 Drawing Figures fig.3
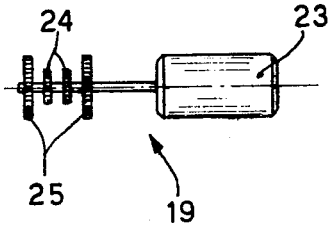
fig.1
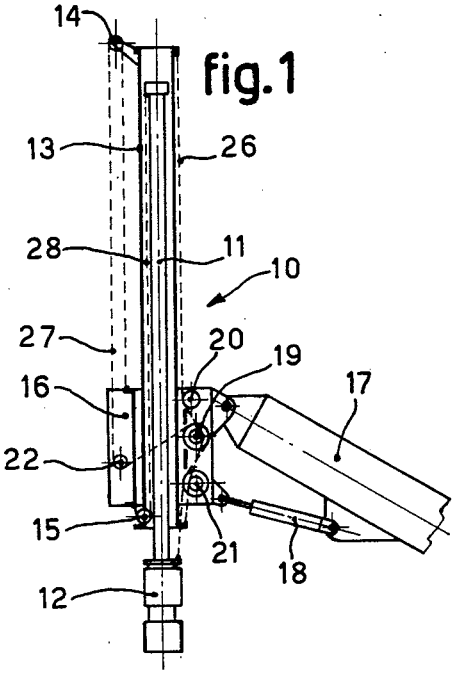
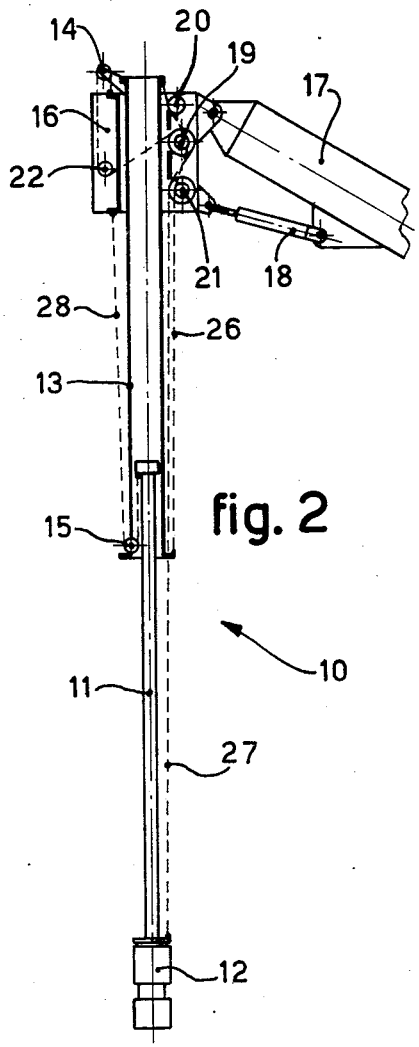
fig. 2
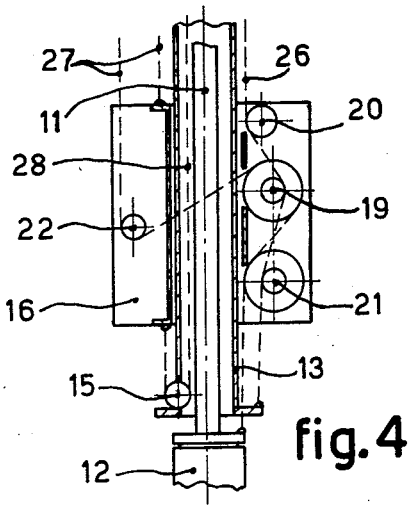
fig.4

TELESCOPIC COLUMNS OF MACHINES FOR MAKING FOUNDATIONS, AND THE TELESCOPIC COLUMNS THEREBY DERIVED

The present invention relates to improvements to the telescopic columns of machines for making foundations. More particularly, the invention relates to improvements to telescopic columns operating buckets and the like used in making foundations, digging trenches and the like, and the telescopic columns thereby derived.

Telescopic columns are known in the art which are suitable for this purpose and consist of two, three or more elements. The inner element generally is the driven element. In fact, in columns of this kind the descending and/or ascending action of the columns is imparted only to the inner column, which draws with it during its descent the other columns until the latter reach their limit stop.

During ascent also the central column moves upwards alone until its lateral projections begin to operate against the shoulder of the next outside column. Thereafter both columns ascend together, and so on in the case of any other columns external to both of them.

This solution has various disadvantages such as: the need for buffer systems in the shoulder of the columns; a discontinuous requirement for power from the lifting means with consequent difficult adjustment of force; complex construction; minimum control of the columns from that moment in the descent when the outermost column reaches the end of its course.

There is also a patented system by the present applicant, which arranges, when there are two telescopic columns and the outer of the two is guided by an immovabe guiding half-column, that only the outer movable column should be guided. This is done by transmission means.

With reference to the known systems, the improvements now proposed enable the buffer systems to be eliminated with consequent simplification of construction; a gradual and constant force to be applied both to the bucket or other implement and also to the speed of descent; and an optimum value of guidance of the columns to be obtained, this value decreasing only when all the columns are fully extended.

In respect of the system proposed by the present invention, the improvements now put forward provide better operation of the shafts, a more constant and coordinated control thereof and a new method of working of the drive means.

The invention consists of a drive means, such as a hydraulic or other type of motor, secured in an immovable manner to a guide canoe means and driving two pairs of chains. One pair of chains is connected at its ends to the upper and lower part of the outermost movable shaft. The other pair of chains is connected at one end to the lower part of the innermost shaft and then, after passing through the drive means and a group of transmission chain pulleys, is secured to the guide canoe means.

The guide canoe means has a pair of cables coupled to its lower end. The cables pass through a transmission sheave positioned at the lower end of the outermost shaft and are then coupled to the upper end of the innermost shaft.

Between the diameter of the outer pair and that of the inner pair of chain pulleys of the drive means there is a transmission ratio of 2:1. This means that the unwinding speed of one pair of chains is twice the speed of the other pair of chains, wherein the outer pair drives the inner shaft while the inner pair drives the outer shaft.

Thus by activating the drive means one has the situation where the outer column descends by a certain value at a certain speed and that at the same time the inner column, owing to the aforesaid ratio, descends by twice the value and at twice the speed of the outer column.

To obtain a better understanding of the invention, reference is made to the drawings which is given as a non-limitative example and wherein:

FIG. 1 shows a vertical section of the invention in a fully closed-up position;

FIG. 2 shows a vertical section of the invention in a fully extended position;

FIG. 3 shows the drive group diagrammatically; and

FIG. 4 is a vertical section of the invention and shows the path of the cables.

In the figures the same parts or parts performing the same functions have been given the same reference numbers.

In FIG. 1, 10 is generically the subject of the invention and consists of an inner column 11 to the end of which is fixed the implement 12 (bucket or other means). Column 13 is outside of 11 and has a chain pulley 14 secured to its upper end, while close to its lower end a sheave 15 is positioned. Outside columns 11 and 13 there is the guide canoe means 16, which is hinged in its upper part to a trellis-wise arm 17 of the carrying structure (not shown) and in its lower part to the hydraulic piston 18, which is suitable for orienting the telescopic column and is in turn hinged to the arm 17. On canoe means 16, on the same side as the arm 17, is motor group 19 positioned centrally. Above and below motor group 19 there are positioned the tensioning pulleys 20 and 21 respectively, while on the other side of the column there is another transmission pulley 22. The drive group 19 advantageously consists of a hydraulic motor 23, (FIG. 3) onto which two pairs of chain pulleys are keyed, the inner pair being 24 and the outer pair 25. The outer pair 25 having a diameter twice as large as that of the first pair 24.

On pair 25 there operates the pair of chains 27, which is secured at one end to the lower end of the inner column 11 and at its other end to the upper end of the canoe means 16 and passes suitably through the transmission chain pulleys 21, 22 and 14. Pair of chains 26 extend from the lower end of column 13 around chain pulleys 24 to the upper end of column 13. The pair of cables 28 is secured to the lower end of the guide canoe means 16 and, through the transmission sheave 15, arrives at the upper end of the inner column 11.

The telescopic columns operate in such a way that one turn of the pair of chain pulleys 24 corresponds to a movement of the outer column 13 of X centimeters and thus to a consequent movement of the inner column 11 of twice X centimeters since, as was stated previously, the pair of pulleys has a ratio of 1:2 to the pair of pulleys 25.

For example, if the drive group 19 is activated to make the column descend, the chain pulley 24 will draw the chain 26 through one revolution with itself, thus causing the outer column 13 to descend by a distance X.

The inner column 11 also descends at the same time but by a distance of twice X, both because it is released by the sheave 15 positioned on the descending outer column 13 and also because of its own weight inasmuch as the sheave 14 positioned on the outer column 13, by decending, frees a length of chain equal to twice the length of its own movement. This length of chain is taken up by the pulleys 25, which thus allows the inner column 11 to descend by a distance 2X at a speed twice as great as that of the outer column 13. Thus the distance of the descent of the telescopic column group 10 in respect of the immovable guide canoe means 16 is twice X equally divided between the two columns.

As can be seen in the descent of the columns, there is an optimum condition of guidance, which persists almost up to the fully extended position.

For the ascent the columns are returned by the drive group 19, the drawing action of the upper chain pulley 14 of the outer column 13 providing assistance for the inner column 11.

There has been described a preferential, non-limitative solution of the invention, but an expert in this field could derive other possible solutions without thereby departing from the scope of protection of the inventive idea.

Thus it is possible to vary proportions and sizes, to replace the chains with smooth or serrated cables and vice versa and also to position the drive group elsewhere.

What is claimed is:

1. In telescopic columns of machines for making foundations consisting of an axially immovable canoe means, a movable outer column guided by said canoe means and a movable inner column within said outer column and guided by said outer column, the improvements including in reciprocal coordination and cooperation a drive means comprising at least two guide pulleys having a proportion to each other of one to two; a chain secured to the two ends of the outer movable column and driven by the smaller of said pulleys; a chain secured to the lower part of the inner movable column and to the upper part of the axially immovable guide canoe means and driven by said larger of said pulleys; a cable connecting the upper part of the inner movable column to the lower part of the axially immovable guide canoe means and a transmission sheave solidly fixed to the lower part of the outer movable column through which passes said cable.

2. In the telescopic columns of machines for making foundations as in claim 1 including a first transmission pulley fixed to the guide canoe means, and a second transmission pulley anchored to the upper end of the outer column, said chain secured to the lower part of the inner movable column passing in succession to the larger pulley, thereafter to said first transmission pulley, next to said second transmission pulley and thereafter arriving at a fixed anchorage means in said canoe means.

3. In the telescopic columns of machines for making foundations as in claim 1 the guide pulleys are arranged in two pairs and said chains are in pairs.

4. In the telescopic columns of machines for making foundations as in claim 1 the drive means is a motor.

5. Telescopic columns for making foundations including in reciprocal coordination and cooperation a motor group comprising at least two guide pulleys having a proportion to each other of one to two; inner and outer movable columns; axially immovable canoe guide means surrounding said columns; a chain secured to the two ends of the outer movable column and driven by the smaller of said pulleys; a chain secured to the lower part of the inner movable column and to the upper part of the axially immovable guide canoe means and driven by the larger pulley; a cable connecting the upper part of the inner movable column to the lower part of the axially immovable guide canoe means and a transmission sheave solidly fixed to the lower part of the outer movable column through which passes said cable.

* * * * *